United States Patent [19]

Betti et al.

[11] Patent Number: 4,967,139

[45] Date of Patent: Oct. 30, 1990

[54] TEMPERATURE-INDEPENDENT VARIABLE-CURRENT SOURCE

[75] Inventors: Giorgio Betti; Maurizio Zuffada, both of Milan; Fabrizio Sacchi, Gambarana; Silvano Gornati, Casorezzo, all of Italy

[73] Assignee: SGS-Thomson Microelectronics S.r.l., Agrate Brianza, Italy

[21] Appl. No.: 509,435

[22] Filed: Apr. 16, 1990

[30] Foreign Application Priority Data

Apr. 27, 1989 [IT] Italy ..... 20281 A/89

[51] Int. Cl.[5] ..... G05F 3/08

[52] U.S. Cl. ..... 323/312; 323/907

[58] Field of Search ..... 323/311, 312, 349, 907

[56] References Cited

U.S. PATENT DOCUMENTS

| | | | |
|---|---|---|---|
| 3,979,663 | 9/1976 | Herchner | 323/312 |
| 4,150,309 | 4/1979 | Tokuda | 323/312 |
| 4,241,315 | 12/1980 | Patterson et al. | 323/315 |
| 4,475,077 | 10/1984 | Nagano | 323/312 |
| 4,587,478 | 5/1986 | Kasperkovitz et al. | 323/907 |
| 4,647,839 | 3/1987 | Siligoni et al. | 323/312 |
| 4,689,549 | 8/1987 | Davis | 323/907 |
| 4,906,915 | 3/1990 | Abdi | 323/312 |

*Primary Examiner*—Steven L. Stephan
*Assistant Examiner*—Jeffrey Sterrett
*Attorney, Agent, or Firm*—Guido Modiano; Albert Josif

[57] ABSTRACT

This variable-current source comprises a differential stage and a pair of voltage buffers which respectively receive, at the input, a variable input voltage and a reference voltage and are connected at the output to the differential stage. Both buffers comprise a resistor flown by a current which varies only as a function of the respective input voltage and of its resistance and therefore depends thermally exclusively on this resistance, and provide output voltages which depend upon these currents, so that the output current generated by the differential stage is temperature-independent.

9 Claims, 1 Drawing Sheet

TEMPERATURE-INDEPENDENT VARIABLE-CURRENT SOURCE

BACKGROUND OF THE INVENTION

The present invention relates to a temperature-independent variable-current source.

As is known, the need is often felt to generate a current which is correlated to a variable external voltage but is practically insensitive to the temperature variations which may affect the integrated circuit in which the souce is physically comprised. It is sometimes also required that the variation range of the produced current be fixed and preset, thus ensuring that the value of the current is always comprised between a minimum value and a maximum value.

Current sources adapted to generate a current which is variable as a function of an input voltage are known in variousd forms. For example, FIG. 1 illustrates a very simple diagram implementing a variable current source. In this circuit, which comprises a current mirror formed by a pair of transistors $T_1$ and $T_2$ (of which $T_1$ is diodeconnected) both of which have their emitters connected to the power supply $V_{CC}$, their bases connected to one another and their collectors which respectively define, through the resistor R, the input (contact pad 1) receiving the variable input voltage $V_{IN}$ and the output feeding the output current $I_O$, the following is true:

$$I_X = \frac{V_{CC} - V_{IN} - V_{BE1}}{R}$$

where $V_{BE1}$ is the base-emitter drop of the transistor $T_1$.

The mirror structure, with $T_1 = T_2$, forces $I_O = I_X$ so that by varying the input voltage $V_{IN}$ the output current $I_O$ varies accordingly.

However, since $V_{BE1}$ and R are temperature-dependent, $I_O$ has the following thermal drift:

$$\frac{\partial I_O}{\partial T} = \frac{\frac{-\partial V_{BE1}}{\partial T} \cdot R - (V_{CC} - V_{IN} - V_{BE1}) \frac{\partial R}{\partial T}}{R^2}$$

wherein the input voltage $V_{IN}$ is assumed to be temperature-independent. This equation generally yields a non-zero result, so that the described structure supplies an output current the value whereof varies according to the temperature.

Another structure used to generate variable currents is shown in FIG. 2, and comprises a pair of transistors $T_3$ and $T_4$, the emitters whereof are coupled through the resistor R'; the bases of said transistors are respectively connected to the input voltage $V_{IN}$ and to a reference voltage $V_{REF}$. The collector of $T_4$ is furthermore connected to the supply voltage $V_{CC}$, the emitter of $T_3$ is connected to a fixed current source I and its collector defines the output which supplies the current $I_O$. The following relations are true for this circuit:

$$I_Y = \frac{(V_{REF} - V_{BE4}) - (V_{IN} - V_{BE3})}{R'}$$

$$I_O = I - I_Y$$

wherein $V_{BE3}$ and $V_{BE4}$ are the base-emitter drops of $T_3$ and $T_4$. By rewritting $I_Y$, the following is obtained:

$$I_Y = \frac{V_{REF} - V_{IN} + (V_{BE3} - V_{BE4})}{R'} = \frac{(V_{REF} - V_{IN}) + \frac{KT}{q} \ln\left(\frac{I_O}{I_Y}\right)}{R'}$$

inserting the law which links the collector current to the base-emitter drop of $T_3$ and $T_4$.

The temperature-dependence of $I_Y$, and therefore of $I_O$, is thus evident, so that the desired temperature-independence cannot be achieved even with the structure shown in FIG. 2.

SUMMARY OF THE INVENTION

Given this situation, the aim of the present invention is to provide a variable-current source which is truly temperature-independent.

Within this aim, a particular object of the present invention is to provide a current source wherein the variation range of the output current is fixed and present.

An important object of the present invention is to provide a current source in which the dependence of the output current upon the input voltage can be adjusted according to the application and to the requirements.

Not least object of the present invention is to provide a current source which is highly reliable, can be easily integrated without entailing complications and without requiring large silicon areas and which does not require, for its manufacture, devices or procedures different from those commonly in use in the electronic industry.

This aim, the objects mentioned and others which will become apparent hereinafter are achieved by a temperature-independent variable-current source as defined in the accompanying claims.

BRIEF DESCRIPTION OF THE DRAWINGS

The characteristics and advantages of the invention wil become apparent from the description of two preferred embodiments, illustrated only by way of non-limitative example in the accompanying drawings, wherein:

FIGS. 1 and 2, which illustrate two known solutions which have already been described, are not described hereinafter.

DESCRIPTION OF THE PREFERRED EMBODIMENTS

Figure 1:
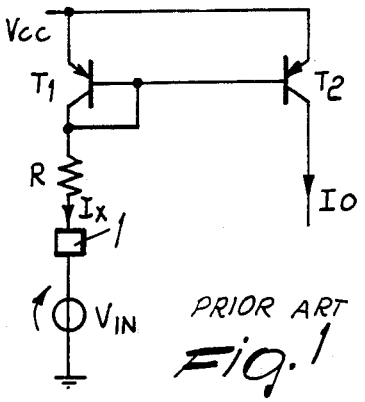
PRIOR ART Fig. 1
FIGS. 1 and 2 show prior current sources.
Figure 2:
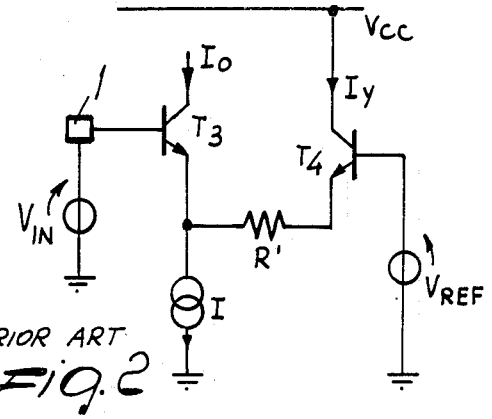
PRIOR ART Fig. 2
Figure 3:
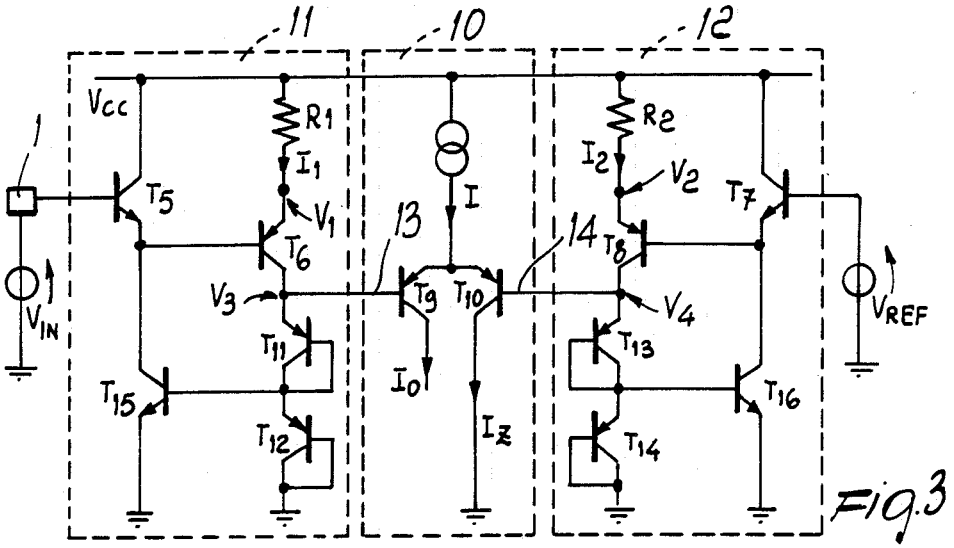
FIG. 3 shows a first embodiment of the variable-current source accoding to the invention.

Reference should instead be made to FIG. 3, which shows the variable-current source according to the invention. As can be seen, the current source comprises a differential stage, generally indicated at 10, and a pair of voltage decoupling stages of buffers 11 and 12. Said buffers are the object of a co-pending patent application in the name of the same Assignee, but are described in detail herein for understanding the operation of the entire current source circuit.

In detail, the differential stage 10 comprises a pair of transistors $T_9$ and $T_{10}$ of the PNP type having their emitters mutually coupled and connected to a fixed current source element I and their bases defining the inputs 13 and 14 of the differential stage. The collector of $T_9$ defines the output of the current source which supplies the output current $I_O$ which is required to be variable but temperature-independent, whereas the collector of $T_{10}$, flown by the current $I_Z$, is connected to the ground defining a reference potential line.

The voltage buffers 11, 12 are equal, and each comprises a pair of transistors $T_5$, $T_6$ and $T_7$, $T_8$ respectively. The NPN-type transistors $T_5$, $T_7$ have their base terminals connected respectively to the input voltage $V_{IN}$ (as a function of which the output current is required to vary) and to a reference voltage $V_{REF}$, their collector terminals connected to the supply line $V_{CC}$, which defines a further reference potential line, and their emitter terminals connected to the base terminals of the transistors $T_6$, $T_8$, which have the opposite conductivity type with respect to $T_5$, $T_7$ and are therefore of the PNP type. The transistors $T_6$, $T_8$ are in turn connected, with their emitter terminals, to the supply voltage $V_{CC}$ through resistors $R_1$, $R^2$. Voltages $V_1$, $V_2$ are present on the emitter terminals of $T_6$, $T_8$ and, as will become apparent hereafter, are linked to the respective input voltages and are temperature-indenpendent.

Each buffer furthermore comprises a pair of transistor, respectively $T_{11}$, $T_{12}$ and $T_{13}$, $T_{14}$, which are identical to $T_6$, $T_8$, i.e. are of the PNP type, have the same emitter area and are integrated, if possible, physically proximate in the integrated circuit. $T_{11}$, $T_{12}$ and $T_{13}$, $T_{14}$ are diode-connected in series between $T_6$, respectively $T_8$, and the ground. The connection points between $T_6$ and $T_{11}$ and between $T_8$ and $T_{13}$ represent the outputs of the two buffers, feeding the voltages $V_3$ and $V_4$ which are supplied to the inputs 13 and 14 of the differential stage. Finally, each buffer comprises a further transistor $T_{15}$, $T_{16}$, respectively identical to $T_5$ and $T_7$, i.e. made with the same technlogy, of the NPN type, with the same emitter area, and are integrated, if possible, physically proximate to $T_5$ and $T_7$, respectively. $T_{15}$, $T_{16}$ are connected to the ground with their emitter terminalsm, to the intermediate point between $T_{11}$ and $T_{12}$ and between $T_{13}$ and $T_{14}$ with their base terminals, and to the emitter of $T_5$, respectively $T_7$, with their collector terminals.

For the description of the operation of the current source according to the invention, assume that all the PNP transistors have equal area, like the NPN ones. Assume also that the voltages $V_{IN}$ and $V_{REF}$ are thermally stable voltages and that the current I is temperature-independent.

For the buffer 11, the following is true:

$$V_1 = V_{IN} - V_{BE5} + V_{BE6}$$

wherein $V_{BE5}$ and $V_{BE6}$ represent the base-emitter drop of the transistors $T_5$ and $T_6$.

Except for second-order effects, such as the Early effect, which can be considered negligible, since $T_6$ and $T_{12}$ operate with the same collector current and are identical to one another, they have base-emitter drops which are equal to one another and to the base-emitter drop of $T_{15}$, due to the parallel connection between the base-emitter junctions of $T_{12}$ and $T_{15}$.

Since $T_5$ and $T_{15}$, which have the same dimensions, are also flown by the same current, the following is consequently true:

$$V_{BE5} = V_{BE15} = V_{BE12}.$$

Consequently $$V_1 = V_{IN}$$

and similarly, for the buffer 12, $$V_2 = V_{REF}$$

Each of the two buffers furthermore generates a current which depends on the input voltage, thermally depends only on the value of $R_1$ and $R_2$ and is equal to:

$$I_1 = \frac{V_{CC} - V_{IN}}{R_1}; \quad I_2 = \frac{V_{CC} - V_{REF}}{R_2} \tag{1}$$

as well as an output voltage which depends on the value of the above mentioned respective current and on the temperature:

$$V_3 = 2\frac{KT}{q}\ln\left(\frac{I_1}{I_S}\right); \quad V_4 = 2\frac{KT}{q}\ln\left(\frac{I_2}{I_S}\right). \tag{2}$$

For the differential stage 10, which is supplied by the fixed temperature-independent source element I and is driven by the voltages $V_3$ and $V_4$, the following relations are furthermore true:

$$I = I_O + I_Z \tag{3}$$

$$V_{EB10} - V_{EB9} V_3 = -V_4 \tag{4}$$

where $V_{BE9}$, $V_{BE10}$ are the base-emitter drops of $T_9$ and $T_{10}$ respectively. Furthermore $$V_{EB9} = \frac{KT}{q}\ln\left(\frac{I_O}{I_S}\right) \tag{5}$$

$$V_{EB10} = \frac{KT}{q}\ln\left(\frac{I_Z}{I_S}\right) \tag{6}$$

and, replacing (5), (6) and (2) in (4), the following is obtained:

$$\frac{KT}{q}\ln\left(\frac{I_Z}{I_S}\right) = \frac{2KT}{q}\ln\left(\frac{I_1}{I_2}\right) \tag{7}$$

and therefore, with simple passages, $$I_O = I_Z\left(\frac{I_2}{I_1}\right)^2 \tag{8}$$

Replacing the values of $I_Z$, $I_1$ and $I_2$ obtained from (3) and (1) in this last equation, with simple passages the following is finally obtained:

$$I_O = \frac{I}{1 + \left(\frac{V_{CC} - V_{IN}}{V_{CC} - V_{REF}}\right)^2 \left(\frac{R_2}{R_1}\right)^2} \tag{9}$$

From (9) it can be immediately deduced that $I_O$ is temperature-independent in the entire range of variation of $V_{IN}$. In fact, as mentioned, $V_{In}$, $V_{REF}$ and I are assumed to be thermally invariant, and the ratio $R_1/R_2$ also has this property if both resistors are obtained from the same kind of diffusion.

In practice, as can be seen from (9), with the circuit illustrated in FIG. 3 $I_O$ depends quandratically on $V_{IN}$. However, the dependence of $I_O$ can be modified in various manners, for example by appropriately choosing $V_{REF}$, the ratio $R_1/R_2$, or by introducing a greater or smaller number of diodes in the voltage buffer 11, 12. By way of example, FIG. 4 illustrates a solution in which a cubic rather than quadratic dependence is obtained.

Figure 4:
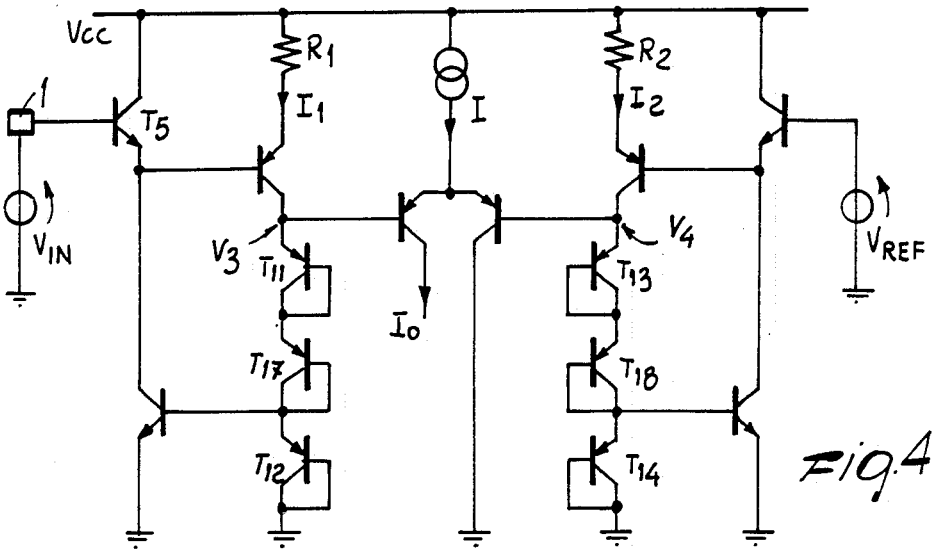
FIG. 4 shows a different embodiment of the current souce according to the invention.

As can be seen, the diagram of FIG. 4 substantially corresponds to that of FIG. 3, with the difference that three diodes are provided between the output of the buffers on which the voltages $V_3$, $V_4$ are taken and the ground, and precisely a further diode $T_{17}$ ($T_{18}$ in the case of the buffer 12) is provided between the collector of $T_{11}$ ($T_{13}$) and the emitter of $T_{12}$ ($T_{14}$).

The following relations are therefore true for the embodiment illustrated in FIG. 4:

$$V_3 = 3\frac{KT}{q}\ln\left(\frac{I_1}{I_S}\right); \quad V_4 = \frac{3KT}{q}\ln\left(\frac{I_2}{I_S}\right) \tag{2'}$$

Using these relations the following is obtained:

$$I_O' = \frac{I}{1 + \left(\frac{V_{CC} - V_{IN}}{V_{CC} - V_{REF}}\right)^3 \left(\frac{R_2}{R_1}\right)^3} \tag{12'}$$

The number of diodes can naturally also be reduced so as to have only the diode $T_{12}$ and $T_{14}$.

The response curve can also be changed by modifying the emitter area of $T_9$ $T_{10}$. In this case, (5) and (6) become $$V_{EB9} = \frac{KT}{q}\ln\left(\frac{I_O}{I_S A_9}\right) \tag{5'}$$

$$V_{EB10} = \frac{KT}{q}\ln\left(\frac{I_Z}{I_S A_{10}}\right) \tag{6'}$$

so that $$I_O'' = \frac{I}{1 + \left(\frac{V_{CC} - V_{IN}}{V_{CC} - V_{REF}}\right)^2 \left(\frac{R_2}{R_1}\right)^2 \left(\frac{A_{10}}{A_9}\right)} \tag{12''}$$

wherein $A_9$, $A_{10}$ are the emitter areas of $T_9$, $T_{10}$.

As can be seen from the above description, the invention fully achieves the proposed aim and objects. A variable-current source has in fact been provided which can generate an output current which is trully temperature-independent in the entire range of variation of the input voltage. The fact is stressed that this result is obtained by virtue of the fact that the currents $I_1$ and $I_2$ from which the differential stage control voltages $V_3$, $V_4$ depend vary according to the temperature only through the value of the resistor $R_1$, respectively $R_2$, and that the differential stage has an output current which depends exclusively on the ratio of said resistors, if its inputs are connected to two identical buffer stages, so that by implementing said resistors with the same technology, their ratio and therefore the output current are temperature-independent.

The current variation range is intrinsically limited by the presence of the differential stage, thus satisfying one of the demands often placed on this kind of circuit.

The invention is furthermore circuitally simple and does not require modifications of the production processes. In the circuit according to the invention, the dependence between the control or input voltage $V_{IN}$ and the generated current $I_O$ can furthermore be easily dimensioned according to the required characteristics by acting on various parameters, in any case preventing the thermal stability of the output current.

The invention thus conceived is susceptible to numerous modifications and variations, all of which are within the scope of the inventive concenpt.

All the details may furthermore be replaced with other technically equivalent ones.

We claim:

1. A temperature-independent variable-current source, comprising a differential stage defining a first and a second input terminals and at least one differential output terminal, and a first and a second mutually identical buffers defining each an input terminal and an output terminal, said input terminals of said first and second buffers being connected respectively to a variable input voltage and to a reference voltage, said output terminals of said first and second buffers being connected respectively to said first and second input terminals of said differential stage, said buffers comprising resistive means defining a resistance and generating each a current which varies as a function of the voltages on said input terminals of said buffers and thermally depends only on said resistance, and said output terminals of said buffers providing each an output voltage which depends on said current, said output voltages being supplied to said differential stage to generate a temperature-independent current at said differential output terminal.

2. A current source, according to claim 1, wherein said differential stage comprises a first and a second transistors defining collector, base and emitter terminals, said emitter terminals being connected to one another and to fixed current source means, said base terminals defining said first and second input terminals of said differential stage connected to said first and second buffers, and said collector terminal of said first transistor defining said differential output terminal of said differential stage.

3. A current source according to claim 1, wherein each said buffer comprises a third transistor of a first conductivity type, having collector and emitter terminals respectively connected to a first and a second reference potential lines, and a base terminal defining a buffer input terminal, said third transistor generating a frist voltage drop between its base and emitter terminals; a fourth transistor of an opposite conductivity type having collector and emitter terminals respectively connected to said second and said first refernece potential line, and a base terminal connected to the emitter terminal of said third transistor, said fourth transistor generating a second voltage drop between its base and emitter terminals; resistive means interposed between said emitter treminal of said fourth transistor and said first reference potential line, detecting means for detecting said second voltage drop of said fourth transistor and controlled current source means controlled by said detecting means so as to supply said third transistor with a corresponding control current which forces said third transistor to operate at a working point wherein said first voltage drop is equal in absolute value to said second voltage drop of said fourth transistor, and to generate a temperature-independent voltage drop across said resistive means.

4. A current source, according to claim 3, wherein said detecting means of said buffers comprises a fifth transistor connected in series to said fourth transistor and flown by a same current, said fifth transistor having said opposite conductivity type and being equal in dimensions to said fourth transistor, so as to generate a base-emitter voltage drop which is equal to said second voltage drop, and said controlled current source means comprises a sixth transistor connected in series to said third transistor and flown by a same current, said sixth transistor having its base and emitter terminals connected in parallel to the base and emitter terminals of said fifth transistor, having said first conductivity type and being equal in dimensions to said third transistor, so as to generate a further base-emitter drop which is equal to said second voltage drop and a corresponding control current supplied to said third transistor.

5. A current source according to claim 3, wherein said first reference potential line is a supply line, said second reference potential line is a ground line, said detecting means comprises a fifth transistor in series with said fourth transistor and said controlled current source means comprises a sixth transistor connected in series to said third transistor with an emitter-base junction in parallel to an emitter-base junction of said fifth transistor, said third transistor having itss collector terminal connected to said supply line and its emitter terminal connected to the collector terminal of said sixth transistor, said fourth transistor having its emitter terminal connected to said supply line through resistive means and its collector terminal connected to the emitter terminal of said fifth transistor, said fifth transistor having its base and collector terminals short-circuited and connected to the ground, said sixth transistor having its base terminal connected to the emitter terminal of said fifth transistor and its emitter terminal connected to the ground.

6. A current source according to claim 4, wherein each said buffer further comprises at least one seventh transistor which has its base and collector terminals short-circuited and its emitter terminal connected to the collector terminal of said fouth transistor and its collector terminal connected to the emitter terminal of said fifth transistor.

7. A current souce according to claim 4, wherein each said buffer further comprises a plurality of transistors having short-circuited base and collector terminals and being connected in series between the collector terminal of said fourth transistor and the emitter terminal of said fifth transistor.

8. A current source according to claim 2, wherein said first and second transistors of said differential stage have a preset area ratio for setting different output currents.

9. A current source according to claim 4, wherein said third and sixth transistors are of the NPN type and said fourth and fifth transistors are of the PNP type.

* * * * *